US012012731B2

(12) United States Patent
Bertolotti et al.

(10) Patent No.: US 12,012,731 B2
(45) Date of Patent: Jun. 18, 2024

(54) APPARATUS AND METHOD FOR CONTROLLING THE DISTRIBUTION OF A FLUID, WITH AN ANTI-FREEZE SAFETY FUNCTION

(71) Applicant: I.V.A.R. S.P.A., Prevalle (IT)

(72) Inventors: Umberto Bertolotti, Prevalle (IT); Stefano Bertolotti, Brescia (IT)

(73) Assignee: I.V.A.R. S.P.A., Prevalle (IT)

( * ) Notice: Subject to any disclaimer, the term of this patent is extended or adjusted under 35 U.S.C. 154(b) by 0 days.

(21) Appl. No.: 18/018,312

(22) PCT Filed: Jul. 14, 2021

(86) PCT No.: PCT/IB2021/056337
§ 371 (c)(1),
(2) Date: Jan. 27, 2023

(87) PCT Pub. No.: WO2022/023854
PCT Pub. Date: Feb. 3, 2022

(65) Prior Publication Data

US 2023/0304271 A1 Sep. 28, 2023

(30) Foreign Application Priority Data

Jul. 31, 2020 (IT) ..... 102020000018868

(51) Int. Cl.
*E03B 7/12* (2006.01)
*E03B 7/07* (2006.01)

(52) U.S. Cl.
CPC ..... *E03B 7/12* (2013.01); *E03B 7/071* (2013.01)

(58) Field of Classification Search
CPC ..... E03B 7/12; E03B 7/071
See application file for complete search history.

(56) References Cited

U.S. PATENT DOCUMENTS 4,286,617 A * 9/1981 Bedient ..... E03B 7/12 137/334
4,326,589 A * 4/1982 Ballman ..... A62C 35/60 169/5

(Continued)

OTHER PUBLICATIONS

International Search Report and Written Opinion dated Oct. 28, 2021 in corresponding International Application No. PCT/IB2021/056337, 14 pages.

*Primary Examiner* — Kevin R Barss
(74) *Attorney, Agent, or Firm* — MH2 TECHNOLOGY LAW GROUP LLP

(57) ABSTRACT

An apparatus for controlling the distribution of a fluid along a supply line configured to supply a user includes a first hydraulic valve located along the supply line and provided with an inlet, which receives fluid in transit in the supply line; an outlet, which transmits fluid through the first valve to make it continue along the supply line, or which receives fluid coming from a portion of the supply line downstream of the first valve; and a discharge, which discharges outside of the supply line, through the first valve, fluid present in the supply line and coming from a portion of the supply line downstream of the first valve. A second hydraulic valve is operatively located along the supply line at a point downstream from the first valve and provided with an inlet, which receives fluid coming from the outlet of the first valve; an outlet, which transmits fluid through the second valve to make it continue along the supply line; and a bypass inlet, which receives fluid drawn from the supply line at a withdrawal point upstream of the first valve and brought directly to the second valve by means of a bypass duct branching off from the supply line upstream of the first valve.

15 Claims, 2 Drawing Sheets

(56) References Cited

U.S. PATENT DOCUMENTS

| | | | | | |
|---|---|---|---|---|---|
| 5,113,892 | A | | 5/1992 | Hull et al. | |
| 5,150,690 | A | * | 9/1992 | Carter | F02D 19/027 137/599.05 |
| 5,249,745 | A | * | 10/1993 | Bertolotti | B05B 12/06 251/47 |
| 5,421,362 | A | | 6/1995 | Sordello | |
| 6,164,564 | A | * | 12/2000 | Franco | B60S 1/52 239/284.1 |
| 2002/0137455 | A1 | * | 9/2002 | Ivanov | B60S 1/482 454/157 |

* cited by examiner

APPARATUS AND METHOD FOR CONTROLLING THE DISTRIBUTION OF A FLUID, WITH AN ANTI-FREEZE SAFETY FUNCTION

CROSS-REFERENCE TO RELATED APPLICATIONS

This application is a U.S. National Stage application of PCT/IB2021/56337, filed Jul. 14, 2021, pending, which claims priority to Italian Patent Application No. 102020000018868, filed Jul. 31, 2020, the entire disclosures of which are hereby incorporated by reference in their entireties.

The present invention relates to an apparatus for controlling the distribution of a fluid, typically water, along a supply line. In particular, the present invention relates to an apparatus for controlling the distribution of a fluid with an antifreeze safety function. Furthermore, the present invention relates to a method for controlling the distribution of a fluid along a supply line.

The invention finds advantageous application in the technical sector of water or thermo-hydraulic systems for the distribution of sanitary water in civil, commercial or industrial contexts. The invention is particularly suitable for use in water supply lines for users located in outdoor environments.

As is known, hydraulic systems can comprise supply lines, i.e. ducts and branches of the system itself, destined to serve users located in an outdoor environment. These are, for example, taps placed in outdoor places, irrigation pipes, fountains, users located in gardens, etc.

In these cases, the supply lines therefore comprise pipes and ducts located at least partially in the outdoor environment, and therefore subject to water freezing phenomena when the external temperature drops below 0° C. or neighboring values. Furthermore, freezing can also affect devices placed—also outdoors—along the supply line or at the end of it, such as taps, valves, flexible pipes, dispensing devices, etc., and in general elements of the user placed outdoors and supplied by the supply line.

Freezing causes, in particular, the expansion of water in pipes and devices, which can cause ruptures and malfunctions.

To prevent water freezing from causing damage to the supply line and to the various devices located outdoors, some specific solutions are known. First of all, it is known to place a shut-off valve along the supply line, which in the winter season is closed so that the water can no longer flow downstream of it along the supply line. Basically, the shut-off valve isolates the entire section downstream of it and thus prevents the water from circulating in the pipes placed outside until it reaches the user.

The shut-off valve can be manually operated, in which case it must be activated when the outside temperatures begin to approach the freezing limit. Once the cold season has passed, the valve can be deactivated allowing the flow of water again to the user placed outdoors. There are also automatic shut-off valves, controlled by a temperature sensor placed in the outdoor environment, which controls the closing of the valve when the freezing limit is reached.

Alternatively, automatic antifreeze valves are known, which comprise a thermostat capable of opening a discharge outlet when the temperature drops below a threshold value at which there is a risk of water freezing in the pipes. This antifreeze valve must be positioned outdoors along the supply line and in the vicinity to the user, for example in the vicinity to an external tap or the connection for an irrigation pipe: when the activation temperature is reached, the valve opens a small safety outlet which discharges water from the supply line, even if the user is closed This water discharge essentially causes a continuous flow of water in the supply line, which avoids stagnation and consequent freezing of the water in the pipes.

The Applicant has found that the known solutions are not free from drawbacks and may be improved under various aspects.

First of all, although the shut-off valves, in particular those with automatic activation, allow freezing to be prevented in the pipes and devices placed in the external environment, they prevent any use of the outdoor user, for example a tap or a pipe for irrigation. This means that, in the cold season, it is not possible for a user to use the utility placed outdoors, even only occasionally or for a short time. This is undoubtedly a limitation, as it may be necessary for a user to have water for outdoor activities anyway.

The known solution of the antifreeze valves has, in turn, limits and drawbacks. In fact, when the antifreeze safety discharge is opened, a significant amount of water begins to flow along the supply line (to avoid freezing) but this amount is discharged into the external environment, typically to the ground, and this constitutes first of all a waste of water. In addition, outdoor drainage can accumulate, create flooding or puddles and damage the ground or, for example, a pavement placed outside. The water discharged from the antifreeze valve can then freeze on the ground, generating frozen surfaces that are dangerous for users.

Furthermore, the automatic antifreeze valves require that the supply line is always under pressure (and not closed) since—when they are opened with an antifreeze function—a continuous flow of water must begin along the line up to the discharge outlet.

In general, the Applicant has observed that the performances of the known devices are not fully satisfactory and do not fully meet the needs of the users.

In this situation, the object of the present invention, in its various aspects and/or embodiments, is to provide an apparatus for controlling the distribution of a fluid and a method for controlling the distribution of a fluid which can be capable of overcoming one or more of the aforementioned drawbacks.

A further object of the present invention is to propose an apparatus and a method for controlling the distribution of a fluid which allow an effective antifreeze safety function to be obtained, with better performance than known solutions.

A further object of the present invention is to propose an apparatus and a method for controlling the distribution of a fluid capable of offering antifreeze functionality in a simple, convenient and rapid manner.

A further object of the present invention is to propose an apparatus and a method for controlling the distribution of a fluid capable of offering various operating modes, including an antifreeze safety function.

A further object of the present invention is to propose an apparatus and a method for controlling the distribution of a fluid capable of operating according to operating conditions suited to the different needs of a user.

A further object of the present invention is to propose an apparatus for controlling the distribution of a fluid, with an antifreeze safety function, which is easy and quick to manufacture.

A further object of the present invention is to propose an apparatus for controlling the distribution of a fluid, with an antifreeze safety function, characterized by a simple and rational structure.

A further object of the present invention is to create alternative solutions, with respect to the prior art, in the manufacture of apparatuses and methods for controlling the distribution of a fluid with an antifreeze safety function, and/or opening up new design fields.

These and any other objects, which will become apparent in the following description, are substantially achieved by an apparatus for controlling the distribution of a fluid, a method for controlling the distribution of a fluid, a hydraulic system comprising the aforementioned apparatus and a method for installing an apparatus for controlling the distribution of a fluid along a supply line, according to one or more of the appended claims, each of which taken alone (without the relative dependent claims) or in any combination with the other claims, as well as according to the following aspects and/or embodiments, variously combined, also with the aforementioned claims.

Aspects of the invention are listed below.

In a first aspect, the invention relates to an apparatus for controlling the distribution of a fluid along a supply line, the latter being configured to supply a user, or multiple users, with said fluid.

In one aspect, the apparatus comprises a first hydraulic valve, destined to be operatively located along said supply line.

In one aspect, the first valve is provided with an inlet, configured to receive a flow of fluid in transit in said supply line upstream of the first valve.

In one aspect, the first valve is provided with an outlet, configured to transmit a flow of fluid through the first valve and to make it continue along the supply line downstream of the first valve, or to receive fluid coming from a portion of the supply line downstream of the first valve.

In one aspect, the first valve is provided with a discharge, configured to discharge outside the supply line—through the first valve—fluid present in the supply line and preferably coming from a portion of the supply line downstream of the first valve.

In one aspect, the first valve comprises movable control members configured to selectively allow or prevent the passage of fluid, present in the supply line and passing through the first valve, between said inlet, said outlet and said discharge of the first valve.

In one aspect, the apparatus comprises a second hydraulic valve, destined to be operatively located along said supply line at a point downstream from the first valve, along the direction of normal flow of the fluid in the supply line towards said user.

In one aspect, the second valve is provided with a respective inlet, configured to receive a flow of fluid in transit in said supply line and coming from said outlet of the first valve.

In one aspect, the second valve is provided with a respective outlet, configured to transmit a flow of fluid through the second valve and to make it continue along the supply line, downstream of the second valve.

In one aspect, the second valve is provided with a bypass inlet, configured to receive a flow of fluid drawn from the supply line at a point upstream of the first valve and brought directly to the second valve by means of a bypass duct branching off from the supply line upstream of the first valve.

In one aspect, the second valve comprises respective movable control members configured to selectively allow or prevent the passage of fluid, present in the supply line and/or in the bypass duct and passing through the second valve, between said inlet, said outlet and said bypass inlet of the second valve.

In one aspect, the first valve comprises a body on which said inlet, said outlet and said discharge are defined, the body defining an inner chamber of the first valve, in which the passage of fluid takes place, and wherein said control members of the first valve comprise at least one shutter housed in said inner chamber, the shutter being selectively movable in said chamber to define operating configurations of the first valve.

In one aspect, said operating configurations of the first valve include at least:

- a configuration of normal use, in which the shutter is positioned in the inner chamber of the first valve in such a way as to put the inlet in communication with the outlet of the first valve, to thus transmit fluid from the inlet to the outlet, and simultaneously close the discharge;
- a safety closed configuration, in which the shutter is positioned in the inner chamber of the first valve in such a way as to close the inlet without transmitting fluid through the first valve, and at the same time put the outlet in communication with the discharge, so that the fluid present in the supply line downstream of the outlet of the first valve is transmitted through the outlet to the discharge of the first valve.

In a safety configuration, the fluid present in the supply line downstream of the outlet of the first valve flows in the opposite direction to the flow direction of the fluid during normal use, and thus it is brought progressively to the outlet of the first valve, and from the outlet to the discharge.

In one aspect, in the normal use configuration the inlet and outlet are open and the discharge is closed.

In one aspect, in the safety closes configuration the inlet is closed and the outlet and discharge are open.

In one aspect, in the configuration of normal use the flow of fluid in transit in the supply line crosses the first valve without interruptions and can supply said user, or said multiple users.

In one aspect, in the safety closed configuration, the flow of fluid passing through the supply line is blocked by the first valve and cannot cross it to proceed towards the second valve.

In one aspect, the second valve comprises a body on which said respective inlet, said respective outlet and said bypass inlet are defined, the body defining a respective inner chamber of the second valve, in which the passage of fluid takes place, and wherein said control members of the second valve comprise at least one respective shutter housed in said inner chamber, the shutter being selectively movable in said chamber to define operating configurations of the second valve.

In one aspect, said operating configurations of the second valve include at least:

- an open configuration, in which the shutter is positioned in the inner chamber of the second valve in such a way as to put the inlet in communication with the outlet of the second valve, to thus transmit fluid from inlet to outlet, or vice versa from outlet to inlet, and at the same time close the bypass inlet;
- a bypass configuration, in which the shutter is positioned in the inner chamber of the second valve in such a way as to close the inlet and simultaneously put the bypass inlet in communication with the outlet of the second valve, so that the fluid present in the bypass duct, branching off from the supply line upstream of the first valve and carrying a flow of fluid from the supply line, is transmitted—through the outlet of the second valve—downstream of the second valve along the supply line.

In one aspect, in the open configuration the inlet and outlet of the second valve are open and the bypass inlet is closed.

In one aspect, in the bypass configuration the inlet is closed and the outlet and the bypass inlet are open.

In one aspect, in the open configuration the flow of fluid in transit in the supply line, coming from the outlet of the first valve, if the first valve is in the configuration of normal use, or directed to the outlet of the first valve, if the first valve is in the safety closed configuration, it can pass through the second valve without interruptions respectively to supply said user, or said multiple users, or to be sent to the discharge of the first valve.

In one aspect, in the bypass configuration the flow of fluid along the supply line between the first and the second valve is blocked and the passage from the bypass line is opened through the second valve, to transmit fluid from the bypass duct to the supply line downstream of the second valve.

In one aspect, the apparatus, comprising the first valve and the second valve operatively placeable along said supply line, is configured to selectively operate at least between the following operating conditions:

- a condition of normal supply, in which the first valve is in said configuration of normal use and at the same time the second valve is in said open configuration;
- an antifreeze closed condition, in which the first valve is in said safety closed configuration and at the same time the second valve is in said open configuration;
- a bypass condition, in which the first valve is in said safety closed configuration and at the same time the second valve is in said bypass configuration.

In one aspect, each of said operating conditions of the apparatus is defined by the combination of the operating configuration of the first valve and the operating configuration of the second valve.

In one aspect, the apparatus is configured to selectively operate, at each moment, in only one of said operating conditions.

In one aspect, the apparatus comprises a temperature sensor configured to measure a temperature value, said temperature sensor being connectable to, and/or operatively active on, said first valve, for controlling the movement of said control members of the first valve and determining the operating configuration of the first valve.

In one aspect, the apparatus is configured in such a way that:

- if the temperature sensor measures a temperature value above a certain settable threshold value, the first valve is kept in said configuration of normal use;
- if the temperature sensor measures a temperature value below said threshold value, the first valve is brought into said safety closed configuration.

In one aspect, the temperature sensor is a capillary or fluid expansion sensor, and is connected by means of a thin tube to the shutter of the first valve, for determining the transition thereof between the normal use configuration and the safety closed configuration on the basis of the temperature value measured with respect to the threshold value.

In one aspect, the first valve is a motorized valve provided with an actuator configured to automatically move the shutter, and the temperature sensor is an electronic sensor configured to send a command signal to suitable processing means of the first valve configured to receive said command signal and operate said actuator, the command signal being able to be a temperature signal higher than said threshold value, which determines the movement of the shutter by the actuator to bring the valve to the configuration of normal use, or a temperature signal lower than said threshold value, which determines the movement of the shutter by the actuator to bring the valve into the safety closed configuration.

In one aspect, said threshold value is an antifreeze safety value, for example 10° C. or 5° C. or 3° C., selected to avoid freezing of the fluid inside the supply line.

In one aspect, the first valve is an automatic valve controlled by said temperature sensor, so that the transition of the first valve between the configuration of normal use and the safety closed configuration occurs automatically on the basis of the comparison between the temperature measured by the temperature sensor and the set threshold value, In one aspect, the second valve can be activated voluntarily by a user in such a way as to select at will the operating configuration of the second valve, and in particular to bring the second valve into the bypass configuration when the first valve is in the safety closed configuration, to bring the supply fluid to the user, or to the users, through the bypass duct.

In one aspect, the second valve is a manually operated valve, or it is a motorized valve that can be remotely controlled by a user, for example by means of an electronic control device and/or a software application.

In one aspect, said condition of normal supply of the apparatus is an active condition when the temperature in the place of installation of the apparatus or of the user supplied by the supply line at which the apparatus is installed, is higher than a threshold value below which fluid freezing can occur inside the supply line.

In one aspect, said antifreeze closed condition of the apparatus is a condition activated when the temperature in the place of installation of the apparatus or of the user supplied by the supply line at which the apparatus is installed, is below a threshold value below which fluid freezing can occur inside the supply line.

In one aspect, said apparatus bypass condition is a condition that can be activated when the temperature in the place of installation of the apparatus or of the user supplied by the supply line at which the apparatus is installed is lower than a threshold value below which fluid freezing can occur inside the supply line, and the first valve is therefore in a safety closed configuration, but it is still desired to supply said user with fluid carried by the supply line, and therefore said second valve is brought into the bypass configuration, to bring fluid to the user through the bypass duct and the second valve, bypassing the first valve.

In one aspect, in said condition of normal supply, the apparatus allows the fluid in the supply line to continuously reach and supply said user (for example a tap or an irrigation pipe).

In one aspect, in said antifreeze closed condition the apparatus interrupts, through the first valve, the flow along the supply line, and at the same time allows the emptying of the portion of the supply line downstream of the first valve and of the second valve, through the discharge of the first valve. In this condition, the fluid present downstream of the outlet of the first valve, up to the user, can travel the supply line in the opposite direction to the flow direction of the fluid during normal use, crossing the second valve in reverse, i.e.

from the outlet to the inlet of the second valve, continuing to the outlet of the first valve and from there passing to the discharge.

In one aspect, in said bypass condition the apparatus operates with the first valve in the safety closed configuration, and therefore without fluid transmission, along the supply line, from upstream to downstream of the first valve, but by virtue of the second valve in the bypass configuration it is possible to activate the flow through the bypass duct, and in this way bring fluid to the second valve, bypassing the first valve, and from the second valve to the user.

In one aspect, the apparatus comprises said bypass duct which branches off from the supply line at a point upstream of the first valve and ending directly in the bypass inlet of the second valve. Said bypass duct is configured to withdraw a flow of fluid from the supply line, at a point upstream of the first valve, and bring it directly to the second valve.

In one aspect, said second valve inlet faces, and is connected to, said outlet of the first valve.

In one aspect, the inlet of the second valve is downstream of the outlet of the first valve.

In one aspect, the inner chamber of the valve is destined to be crossed by the fluid, between the inlet and the outlet selected according to the operating configuration of the valve.

In one aspect, the shutter of the first valve is a ball shutter housed in the inner chamber.

In one aspect, the shutter of the second valve is a ball shutter housed in the respective inner chamber.

In one aspect, the body of the first valve is distinct and separate from the respective body of the second valve.

In this case, the two valves are placed, in series, along the supply line in two distinct points.

In an alternative aspect, the device comprises a single body defining internally, distinct from each other, the inner chamber of the first valve and the inner chamber of the second valve, and provided with both the inlet, the outlet and the discharge of the first valve, and with the inlet, the outlet and the bypass inlet of the second valve.

In this case, the first and second valves are integrated in a single body located along the supply line.

In one aspect, the temperature sensor is destined to be positioned in an external environment with respect to the first and/or second valve.

In one aspect, said user is a water supply point for outdoor use, for example a tap or an irrigation pipe. In one aspect, said fluid is water.

In one aspect, said fluid supply line is a duct of a sanitary water system, and said duct is configured to supply a user, for example a tap, preferably located in an external environment.

In one aspect, the user is located in an external environment with respect to the first and/or the second valve.

In one aspect, the supply line is part of a water or thermo-hydraulic system. In one aspect, the supply line is a domestic cold water supply duct.

In one aspect, the supply line consists of a series of ducts bringing said fluid towards said user, or said users, and is characterized by a flow direction of the fluid during normal use, such direction being directed by the fluid source (e.g. a system source of sanitary water) to the user.

In one aspect, the apparatus is assembled, i.e. it has the first valve, the second valve and the bypass duct installed on the supply line.

In an alternative aspect, the apparatus may be in the form of a kit comprising at least the first valve, the second valve, the bypass duct and preferably the temperature sensor, each of these components being ready to be installed in the respective position of the supply line or of the environment in which the user supplied by the power supply line is located. Basically, the apparatus of the present invention may be a disassembled kit (i.e. a set of components to make the apparatus) or assembled in the destination system.

In an independent aspect, the present invention relates to a method for controlling the distribution of a fluid along a supply line, the method comprising the steps of:

- providing an apparatus according to one or more of the above aspects, and in particular providing at least the first valve, the second valve and a bypass duct;
- installing the first hydraulic valve operatively placing it along the supply line;
- installing the second hydraulic valve operatively placing it along the supply line, at a point downstream of the first valve, along the normal flow direction of the fluid in the supply line towards said user, so that the inlet of the second valve follows the outlet of the first valve;
- installing the bypass duct, making it branch off from the supply line at a point upstream of the first valve, so that it can draw fluid from the supply line to bring it directly to the second valve, in particular to the bypass inlet of the second valve.

In one aspect, the control method comprises a step of selecting the operating condition of the apparatus, among one of the following operating conditions:

- a condition of normal supply, in which the first valve is in the configuration of normal use and at the same time the second valve is in the open configuration;
- an antifreeze closed condition, in which the first valve is in the safety closed configuration and at the same time the second valve is in the open configuration;
- a bypass condition, in which the first valve is in the safety closed configuration and at the same time the second valve is in the bypass configuration.

In one aspect, the method comprises a step of installing the temperature sensor, preferably positioning it in the same environment in which the user supplied by the supply line is located.

In one aspect, the method comprises a step of measuring a temperature value by means of the temperature sensor and controlling the movement of the control members of the first valve to determine the operating configuration of the first valve, according to the following control logic:

- if the temperature sensor measures a temperature value above a certain settable threshold value, the first valve is kept in said configuration of normal use;
- if the temperature sensor measures a temperature value below said threshold value, the first valve is brought into said safety closed configuration.

In one aspect, in said step of selecting the operating condition of the apparatus, the selection of the antifreeze closed condition occurs automatically on the basis of the comparison between the temperature measured by the temperature sensor and the set threshold value In one aspect, in said step of selecting the operating condition of the apparatus, the selection of the bypass condition occurs voluntarily, by a user, bringing the second valve into the bypass configuration when the first valve is in the safety closed configuration, to bring the supply fluid to the user through the bypass duct.

In one aspect, the voluntary selection of the bypass condition occurs through a manual activation of the second valve by the user.

In one aspect, the voluntary selection of the bypass condition occurs by means of a remote control, by the user, for example by means of an electronic control device and/or a software application, of the second valve, to bring it into the bypass configuration.

In one aspect, in said step of selecting the operating condition of the apparatus, the selection of the normal supply condition of the apparatus corresponds to a default condition for the apparatus installed on the supply line, active when the temperature in the place of installation of the temperature sensor is higher than a threshold value below which fluid freezing can occur inside the supply line.

In one aspect, in said step of selecting the operating condition of the apparatus, the selection of the antifreeze closed condition of the apparatus takes place, preferably automatically (i.e. without the intervention of a user), when the temperature in the place of installation of the temperature sensor is lower than a threshold value below which fluid can freeze inside the supply line.

In one aspect, in said step of selecting the operating condition of the apparatus, the selection of the bypass condition of the apparatus takes place, preferably voluntarily (i.e. with the intervention of a user) when the temperature in the place of installation of the temperature sensor is lower than a threshold value below which fluid can freeze inside the supply line, and the first valve is therefore in a safety closed configuration, but it is still required to supply the user with fluid brought by the supply line, and therefore said second valve is brought into the bypass configuration, to bring fluid to the user through the bypass duct and the second valve, bypassing the first valve.

In one aspect, if the operating condition selected for the apparatus is the bypass condition, and it is no longer required—by the user—to supply the user with fluid brought by the supply line, it is provided to return to the antifreeze closed condition of the apparatus, by deactivating the bypass duct, obtained by bringing (preferably manually) said second valve to the open configuration.

In this way, the first valve blocks the flow of fluid arriving at its inlet, at the same time there is no fluid entering the second valve from the bypass duct, and it is possible to discharge the fluid present downstream of the first valve (up to the user point) by sliding it backwards (in the direction opposite to the normal supply direction) up to the outlet of the first valve and from there to the discharge.

In other words, once the use of the user has finished, obtained by selecting the bypass condition, it is necessary to return the apparatus to the antifreeze closed condition, restoring the safety operation of the apparatus. Once the temperature has risen above the threshold value, the device will automatically go to normal supply conditions.

In one aspect, in said step of selecting the operating condition of the apparatus, the apparatus may be, at any time, only in one of said operating conditions.

In an independent aspect thereof, the present invention relates to a method for installing an apparatus for controlling the distribution of a fluid along a supply line, the method comprising the steps of:

- providing an apparatus according to one or more of the above aspects, and in particular providing at least the first valve, the second valve and a bypass duct;
- installing the first hydraulic valve operatively placing it along the supply line;
- installing the second hydraulic valve operatively placing it along the supply line, at a point downstream of the first valve, along the normal flow direction of the fluid in the supply line towards said user, so that the inlet of the second valve follows the outlet of the first valve;
- installing the bypass duct, making it branch off from the supply line at a point upstream of the first valve, so that it can draw fluid from the supply line to bring it directly to the second valve, in particular to the bypass inlet of the second valve.

In one aspect, the installation method comprises a step of installing the temperature sensor, preferably positioning it in the same environment in which the user supplied by the supply line is located.

In an independent aspect thereof, the present invention relates to a hydraulic system comprising a supply line and an apparatus according to one or more of the above aspects.

It should be noted that, in the context of the present description and the appended claims, the technical features set out in the aspects referring to the apparatus for controlling the distribution of a fluid are valid in a similar and equivalent manner also for the method for controlling the distribution of a fluid.

Each of the above aspects of the invention may be taken alone or in combination with any of the claims or other aspects described.

Further features and advantages will become more apparent from the detailed description of some embodiments, including also a preferred, exemplary but non-exclusive embodiment of an apparatus for controlling the distribution of a fluid, a method for controlling the distribution of a fluid, a hydraulic system comprising the aforesaid apparatus, and a method for installing an apparatus for controlling the distribution of a fluid along a supply line, according to the present invention. Such description is given hereinafter with reference to the accompanying drawings, provided only for illustrative and, therefore, non-limiting purposes, in which:

Figure 1:
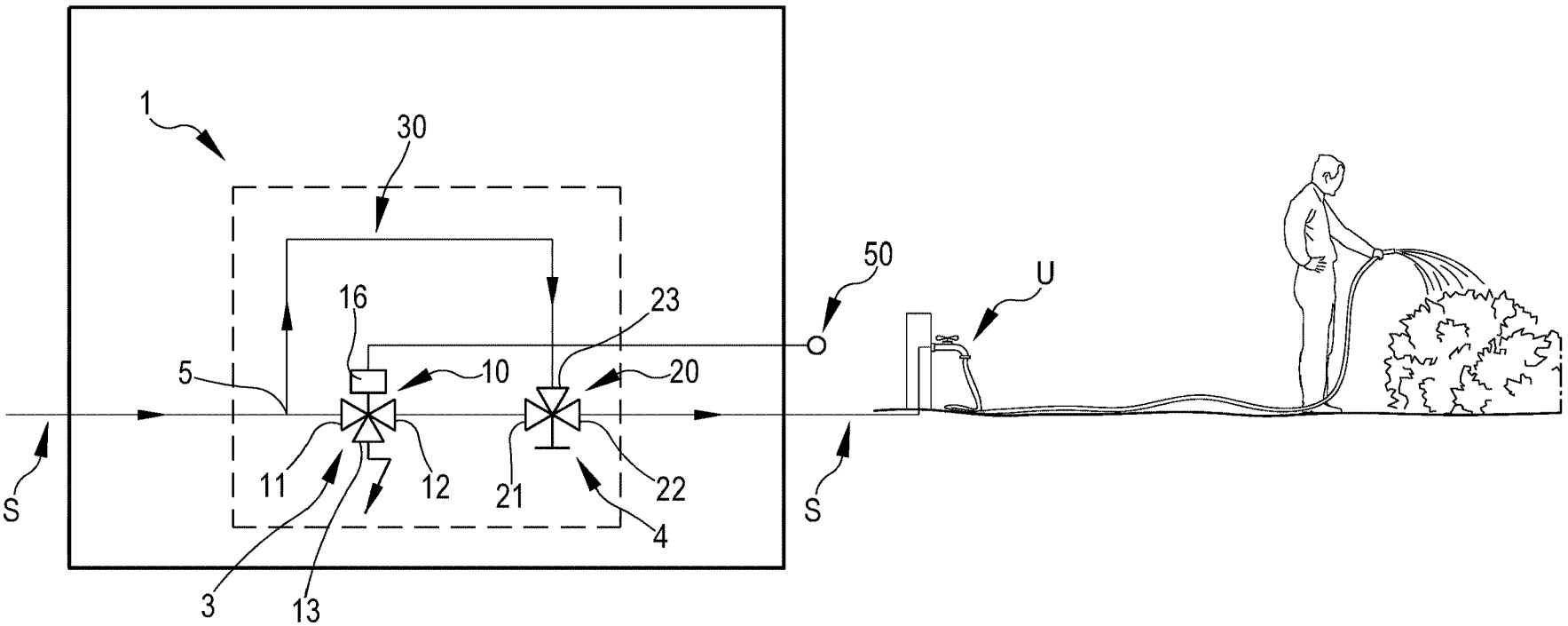
FIG. 1 shows a schematic representation of a possible embodiment of an apparatus for controlling the distribution of a fluid along a supply line according to the present invention, installed along a supply line adapted to supply water to a user located in an external environment.

With reference to the cited figures, reference numeral 1 generally indicates an apparatus for controlling the distribution of a fluid, along a supply line, according to the present invention. In general, the same reference numeral is used for identical or similar elements, possibly in their embodiment variants.

The apparatus 1 for controlling the distribution of a fluid along a supply line S is schematically shown in FIG. 1. First of all, observe the supply line S: it essentially consists of a branch or portion of a water or thermo-hydraulic system. In the figure, this system is, in a completely exemplary manner, the hydraulic system of a house. The supply line S will therefore be supplied with water, preferably domestic cold water, supplied by an aqueduct or by a centralized pump which supplies water to the entire system, and through it to a plurality of users.

The supply line S is therefore configured to supply a user U, or several users, with the aforesaid fluid. This user may be an outdoor tap, an irrigation pipe, a fountain or other similar services typically present in an external environment. In FIG. 1, for example, the user U is an outdoor tap, to which an irrigation pipe may also be connected.

It should be noted that, in the context of the present invention, the user U is a user located in an external environment, and for this reason both the user U and part of the supply line are subject to freezing phenomena of the fluid (water) when the outside temperature drops below or around 0° C., for example in the winter season. Of course, this example is not limiting: the apparatus of the present invention may be applied in the same way also in other fields, for example on industrial plants for the control of operating fluids also other than water. Having clarified the context of application of the apparatus 1, and the exemplary situation shown in FIG. 1, first of all the apparatus comprises a first hydraulic valve 10 and a second hydraulic valve 20.

The first hydraulic valve 10 is destined to be operatively located along the supply line S, in a first position 3, and is provided with:

- an inlet 11, configured to receive a flow of fluid in transit in the supply line S upstream of the first valve 10;
- an outlet 12, configured to transmit a flow of fluid through the first valve and to make it continue along the supply line S downstream of the first valve 10 or (based on the operating configuration, as will be illustrated below) to receive fluid coming from a portion of the supply line S downstream of the first valve;
- a discharge 13, configured to discharge outside the supply line S—through the first valve 10—fluid present in the supply line S and preferably coming from a portion of the supply line downstream of the first valve 10;
- movable control members configured to selectively allow or prevent the passage of fluid, present in the supply line S and passing through the first valve 10, between the inlet 11, the outlet 12 and the discharge 13 of the first valve.

The second hydraulic valve 20 is destined to be operatively located along the supply line S at a point downstream from the first valve (i.e. in a second position 4), along the direction of normal flow of the fluid in the supply line S towards the user U. The second valve 20 is provided with:

- a respective inlet 21, configured to receive a flow of fluid in transit in the supply line S and coming from the outlet 12 of the first valve 10;
- a respective outlet 22, configured to transmit a flow of fluid through the second valve 20 and to make it continue along the supply line S, downstream of the second valve;
- a bypass inlet 23, configured to receive a flow of fluid drawn from the supply line S at a withdrawal point 5 upstream of the first valve 10 and brought directly to the second valve 20 by means of a bypass duct 30 branching off from the supply line S upstream of the first valve (at the withdrawal point 5);
- respective movable control members configured to selectively allow or prevent the passage of fluid, present in the supply line S and/or in the bypass duct 30 and passing through the second valve 20, between the inlet 21, the outlet 22 and the bypass inlet 23 of the second valve 20.

Preferably, the first valve 10 comprises a body (schematically represented in the figures) on which the inlet 11, the outlet 12 and the discharge 13 are defined; such body defines an inner chamber of the first valve, in which the passage of fluid takes place. The control members of the first valve 10 comprise at least one shutter 14 housed in the inner chamber, which is selectively movable in the chamber to define operating configurations of the first valve 10.

Preferably, such operating configurations of the first valve 10 include at least:

- a configuration of normal use, in which the shutter 14 is positioned in the inner chamber of the first valve 10 in such a way as to put the inlet 11 in communication with the outlet 12 of the first valve 10, to thus transmit fluid from the inlet 11 to the outlet 12, and simultaneously close the discharge 13;
- a safety closed configuration, in which the shutter 14 is positioned in the inner chamber of the first valve 10 in such a way as to close the inlet 11 without transmitting fluid through the first valve 10, and at the same time put the outlet 12 in communication with the discharge 13, so that the fluid present in the supply line S downstream of the outlet 12 of the first valve 10 is transmitted, through the outlet 12 itself, to the discharge 13 of the first valve 10.

Figure 2:
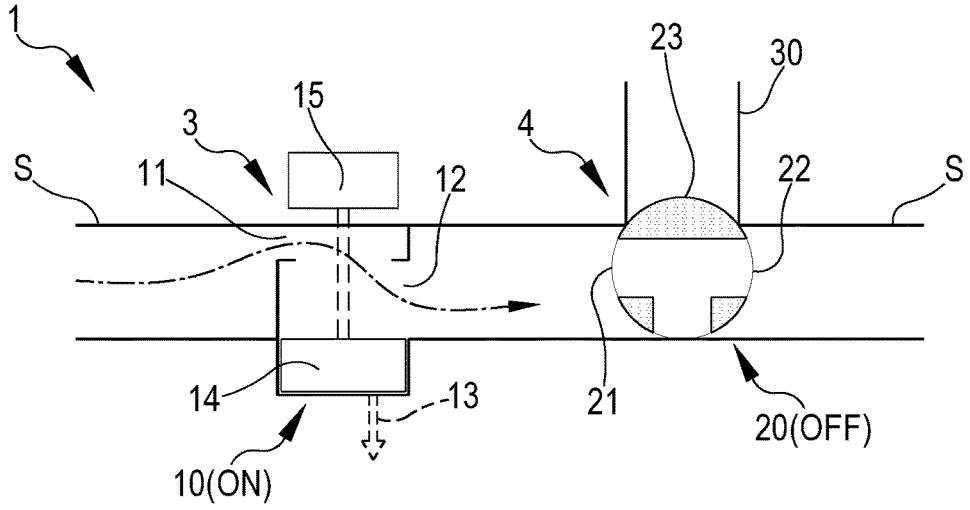
FIG. 2 shows a schematic/functional representation of a portion of an apparatus according to the present invention, according to a possible embodiment, in a first operating condition.
Figure 3:
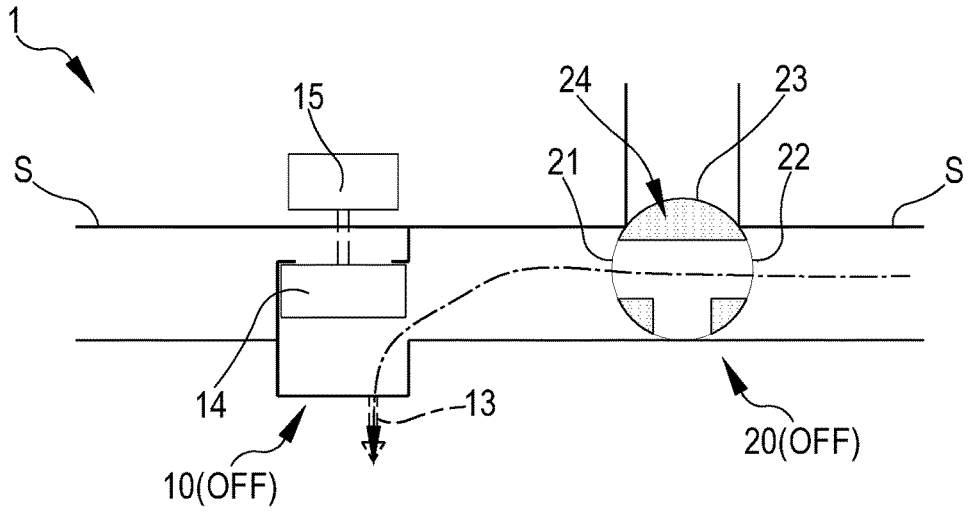
FIG. 3 shows a schematic/functional representation of a portion of an apparatus according to the present invention, according to a possible embodiment, in a second operating condition.
Figure 4:
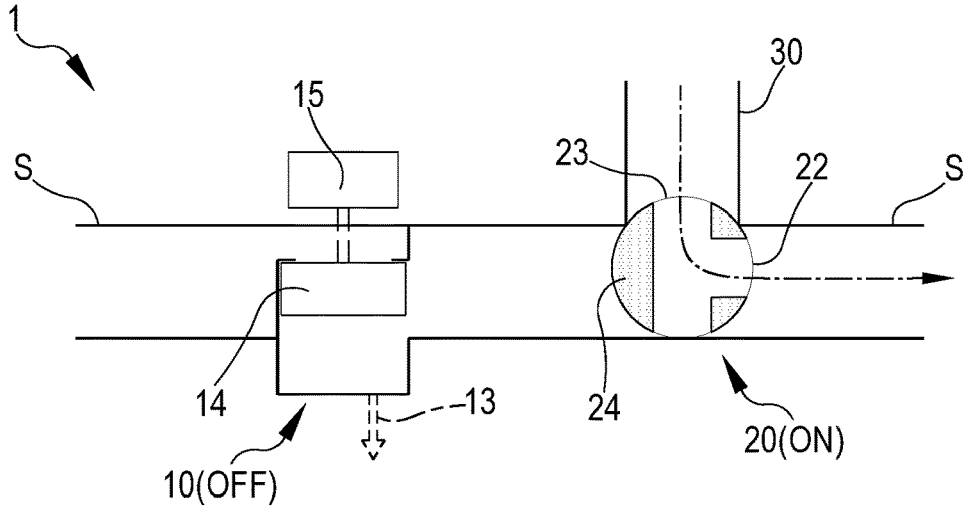
FIG. 4 shows a schematic/functional representation of a portion of an apparatus according to the present invention, according to a possible embodiment, in a third operating condition.

It should be noted that the first valve is shown in the configuration of normal use in FIG. 2, and in the safety closed configuration in FIGS. 3 and 4.

The configuration of normal use can be considered a condition of activation of the first valve (as indicated with "ON" in FIG. 2), since in this configuration there is fluid transmission along the supply line S, between upstream and downstream of the first valve, towards the user U.

On the contrary, the safety closed configuration can be considered a deactivation condition of the first valve (as indicated with "OFF" in FIGS. 3 and 4), since in this configuration there is no fluid transmission from upstream to downstream of the first valve towards the user U, and on the contrary there is a discharge or emptying of the fluid present in the supply line S downstream of the first valve, which takes place by means of a return of fluid towards the outlet 12 of the first valve and from there to the discharge 13.

In other words, in a safety configuration, the fluid present in the supply line S downstream of the outlet 12 of the first valve 10 flows in the opposite direction to the flow direction of the fluid during normal use, and thus it is brought progressively to the outlet 12 of the first valve 10, and from the outlet 12 to the discharge 13.

Preferably, as shown by way of example in FIG. 2, in the configuration of normal use the inlet 11 and outlet 12 are open and the discharge 13 is closed.

Preferably, as shown by way of example in FIGS. 3 and 4, in the safety closed configuration the inlet 11 is closed and the outlet 12 and the discharge 13 are open.

Preferably, in the configuration of normal use the flow of fluid in transit in the supply line S crosses the first valve 10 without interruptions and can supply the user U.

Preferably, in the safety closed configuration, the flow of fluid passing through the supply line S is blocked by the first valve 10 and cannot cross it to proceed towards the second valve 20.

Preferably, the second valve 20 in turn comprises a respective body (schematically represented in the figures) on which the inlet 21, the outlet 22 and the bypass inlet 23 are defined; such body defines a respective inner chamber of the second valve 20, in which the passage of fluid takes place. The control members of the second valve 20 comprise at least one respective shutter 24 housed in the inner chamber, which is selectively movable in the chamber to define respective operating configurations of the second valve.

Preferably, such operating configurations of the second valve 20 include at least:

an open configuration, in which the shutter 24 is positioned in the inner chamber of the second valve 20 in such a way as to put the inlet 21 in communication with the outlet 22 of the second valve 20, to thus transmit fluid from inlet to outlet, or vice versa from outlet to inlet, and at the same time close the bypass inlet 23;

a bypass configuration, in which the shutter 24 is positioned in the inner chamber of the second valve 20 in such a way as to close the inlet 21 and simultaneously put the bypass inlet 23 in communication with the outlet 22 of the second valve 20, so that the fluid present in the bypass duct 30, branching off from the supply line upstream of the first valve (at the withdrawal point 5) and carrying a flow of fluid from the supply line, is transmitted—through the outlet 22 of the second valve 20—downstream of the second valve along the supply line S.

It should be noted that the second valve is shown in the open configuration in FIGS. 2 and 3, and in the bypass configuration in FIG. 4.

The open configuration may be considered a condition of deactivation of the second valve (as indicated with "OFF" in FIGS. 2 and 3), since in this configuration the second valve does not intervene on the flow of fluid coming from the first valve 10 and directed to the user U, making it continue along the supply line S.

On the contrary, the bypass configuration may be considered a condition of activation of the second valve (as indicated by "ON" in FIG. 4), since in this configuration the passage of fluid coming from the bypass duct 30 is activated, directing it downstream of the second valve 20 to user U. Basically, the activation of the bypass configuration allows the first valve 10 to be "skipped"—in particular when this is in the safety closed configuration—transmitting fluid to the user through the bypass duct 30 and the second valve 20. In the bypass configuration, the second valve 20 prevents the return of the fluid, downstream of the second valve itself, in the opposite direction with respect to the flow direction of the fluid during normal use; therefore there is no emptying of the fluid present in the supply line S downstream of the first and second valves, which in the condition of FIG. 3 takes place instead by means of a return of fluid towards the outlet 12 of the first valve and from there to the discharge 13.

Preferably, as shown by way of example in FIGS. 2 and 3, in the open configuration the inlet 21 and the outlet 22 of the second valve are open and the bypass inlet 23 is closed.

Preferably, as shown by way of example in FIG. 4, in the bypass configuration the inlet 21 is closed and the outlet 22 and the bypass inlet 23 are open.

Preferably, in the open configuration the flow of fluid in transit in the supply line S, coming from the outlet 12 of the first valve 10 (if the first valve is in the configuration of normal use), or directed to the outlet 12 of the first valve (if the first valve is in the safety closed configuration, FIG. 3), it can pass through the second valve 20 without interruptions respectively to supply the user U (FIG. 2), or to be sent to the discharge 13 of the first valve 10 (FIG. 3).

Preferably, in the bypass configuration the flow of fluid along the supply line S between the first valve 10 and the second valve 20 is blocked and the passage from the bypass line 30 is opened through the second valve 20, to transmit fluid from the bypass duct 30 to the supply line S downstream of the second valve 20 (FIG. 4).

According to the present invention, the apparatus 1, comprising the first valve 10 and the second valve 20 placed along the supply line S, is configured to selectively operate at least between the following operating conditions:

a "condition of normal supply", in which the first valve 10 is in the configuration of normal use and at the same time the second valve 20 is in the open configuration;

an "antifreeze closed condition", in which the first valve 10 is in the safety closed configuration and at the same time the second valve 20 is in the open configuration;

a "bypass condition", in which the first valve 10 is in the safety closed configuration and at the same time the second valve 20 is in the bypass configuration.

Basically, the technical solution of the present invention provides that each of the "operating conditions" of the apparatus is defined by a respective combination of the operating configuration of the first valve 10 and the operating configuration of the second valve 20.

It should be noted that:

the normal supply condition is exemplarily shown in FIG. 2;

the antifreeze closed condition is exemplarily shown in FIG. 3;

the bypass condition is exemplary shown in FIG. 4.

It is possible to schematize the operating conditions of the apparatus 1 as follows. Considering that the first valve 10 can be in the normal use configuration (ON) or in the safety closed configuration (OFF) and the second valve can be in the open configuration (OFF) or in the bypass configuration (ON), the operating conditions of the apparatus are defined by the following pairs of operating configurations of the first 10 and the second valve 20:

| Apparatus 1 operating condition | First valve 10 | Second valve 20 |
|---|---|---|
| Normal supply | ON | OFF |
| Antifreeze closing | OFF | OFF |
| Bypass | OFF | ON |

According to the present invention, each operating condition of the apparatus 1 is therefore defined by a respective pair of conditions of the two valves 10 and 20.

Preferably, the apparatus 1 is configured to operate selectively, at each moment, in only one of the aforementioned operating conditions.

According to a preferred but non-exclusive embodiment, the apparatus 1 comprises a temperature sensor 50 configured to measure a temperature value. Said temperature sensor 50 is connectable to, and/or operatively active on, said first valve 10, to control the movement of the control members of the first valve and to determine the operating configuration of the first valve (i.e. control the ON or OFF state of the first valve).

Preferably, the apparatus 1 is configured in such a way that:

if the temperature sensor 50 measures a temperature value above a certain settable threshold value, the first valve 10 is kept in the configuration of normal use (ON);

if the temperature sensor 50 measures a temperature value below the threshold value, the first valve 10 is brought into the safety closed configuration (OFF).

Basically, the temperature sensor determines, moment by moment, the ON or OFF state of the first valve 10, and therefore its configuration (of normal use or safety closing).

The temperature sensor 50 may be a capillary or fluid expansion sensor, and may be connected by means of a thin tube to the shutter 14 of the first valve 10, for determining the transition thereof between the normal use configuration and the safety closed configuration on the basis of the temperature value measured with respect to the threshold value.

As shown by way of example in the figures, the first valve 10 may be a motorized valve provided with an actuator 15 configured to automatically move the shutter 14, and the temperature sensor 50 is an electronic sensor configured to send a control signal to suitable processing means 16 of the first valve, configured to receive the control signal and consequently operate the actuator 14. The control signal (schematized in FIG. 1 with a functional line connecting the temperature sensor 50 to the processing means 16) may be a temperature signal higher than the threshold value, which causes the movement of the shutter 14 by the actuator 15 to bring the valve to the normal use configuration, or a temperature signal lower than the threshold value, which causes the shutter 14 to be moved by the actuator 15 to bring the valve to the safety closed configuration.

Preferably, the aforementioned threshold value is an antifreeze safety value, for example 10° C. or 5° C. or 3° C., set to avoid freezing of the fluid inside the supply line S.

Preferably, the first valve 10 is an automatic valve controlled by the temperature sensor 50, so that the transition of the first valve between the configuration of normal use and the safety closed configuration occurs automatically on the basis of the comparison between the temperature measured by the temperature sensor 50 and the set threshold value.

Preferably, the second valve 20 can be activated voluntarily by a user in such a way as to select at will the operating configuration of the second valve 20, and in particular to bring the second valve 20 into the bypass configuration when the first valve 10 is in the safety closed configuration, to still bring supply fluid to the user U through the bypass duct 30.

The second valve 20 may be a manually operated valve, or a motorized valve that can be remotely controlled by the user, for example by means of an electronic control device and/or a software application.

See again FIGS. 2, 3 and 4, which show the three operating conditions of apparatus 1. Also note the dashed arrows showing the fluid flow in each operating condition of the apparatus. The overall operation of the apparatus 1 is illustrated below, which corresponds to a method for controlling the distribution of a fluid along a supply line S by means of the apparatus 1.

Preferably, the condition of normal supply of the apparatus (FIG. 2) is an active condition when the temperature in the place of installation of the apparatus 1 or of the user U supplied by the supply line S at which the apparatus is installed, is higher than a threshold value below which there is a risk of fluid freezing inside the supply line S.

Preferably, the antifreeze closed condition of the apparatus (FIG. 3) is a condition activated when the temperature in the place of installation of the apparatus 1 or of the user U supplied by the supply line at which the apparatus is installed, is below a threshold value below which there is a risk of fluid freezing inside the supply line S.

Preferably, the apparatus bypass condition (FIG. 4) is a condition that can be activated when the temperature in the place of installation of the apparatus 1 or of the user U is lower than a threshold value below which fluid freezing can occur inside the supply line, and the first valve 10 is therefore in a safety closed configuration, but it is still desired to supply the user U with fluid carried by the supply line S, and therefore the second valve 20 is brought into the bypass configuration, to bring fluid to the user U through the bypass duct 30 and the second valve 20, bypassing the first valve 10.

Preferably, in the normal supply condition (FIG. 2) the apparatus 1 allows the fluid in the supply line to continuously reach and supply the user U (for example a tap or an irrigation pipe). In this condition, the first 10 and the second valve 20 are not an obstacle to the fluid flow, which can flow through them in the supply line to the user; in such condition, the bypass duct 30 is not used.

Preferably, in the antifreeze closed condition (FIG. 3), the apparatus 1 interrupts, through the first valve 10, the flow along the supply line S, and at the same time allows the emptying of the portion of the supply line S downstream of the first valve 10 and of the second valve 20, through the discharge 13 of the first valve 10. In this condition, the fluid present downstream of the outlet 12 of the first valve 10, up to the user U, can travel the supply line in the opposite direction to the flow direction of the fluid during normal use, crossing the second valve 20 in reverse, i.e. from the outlet 22 to the inlet 21 of the second valve 20, continuing to the outlet 12 of the first valve 10 and from there passing to the discharge 13, which eliminates the fluid from the supply line.

Such reverse path of the fluid, downstream of the first valve 10, in the antifreeze closed condition (FIG. 3) is allowed by the positioning of the first valve 10 in the safety closed configuration and by the positioning of the second valve 20 in the open configuration. In the antifreeze closed condition, the bypass duct 30 is not used (since the bypass inlet 23 is closed).

Preferably, in the bypass condition (FIG. 4), the apparatus 1 operates with the first valve 10 in the safety closed configuration, and therefore without fluid transmission, along the supply line S, from upstream to downstream of the first valve 10, but by virtue of the second valve 20 in the bypass configuration it is possible to activate the flow through the bypass duct 30, and in this way bring fluid to the second valve 20, bypassing the first valve 10, and from the second valve to the user U. In the bypass condition there is no fluid transmission from the first valve 10 to the second valve 20.

It should be noted that, according to the present invention, the apparatus operates normally under normal power conditions (FIG. 2); this is a default condition, without user intervention and with the temperature not below a critical threshold value linked to possible freezing phenomena. When the external temperature, measured by the temperature sensor 50, falls below the threshold value, the apparatus automatically switches to the antifreeze closed condition (FIG. 3), to avoid harmful freezing phenomena in the supply line S. If the user wishes to have fluid for the user, brought by the supply line, he/she can voluntarily set the apparatus to the bypass condition (FIG. 4), avoiding the block placed automatically by the first valve by virtue of the second valve and the bypass duct.

Basically, the condition of FIG. 2 is of normal operation, the condition of FIG. 3 is an automatic passage for safety reasons (antifreeze) and the condition of FIG. 4 is a forcing of the antifreeze block to supply the user anyway, temporarily.

At the end of the use of the user U through the voluntary selection of the bypass condition, the user returns the second valve to the opening configuration, closing the bypass duct. In this way, the antifreeze safety condition is restored, which the device maintains until the temperature rises above the threshold value. Furthermore, by restoring the antifreeze safety condition, the part of the supply line downstream of the first valve (up to the user) is automatically (and immediately) emptied, discharging the residual fluid present in the line due to the previous use in bypass condition.

When the threshold value is exceeded, the apparatus returns to normal supply conditions, in which the user U can be supplied normally through the first and second valves, without the need for the bypass duct.

The selection of the bypass condition is typically performed occasionally by the user, and for short periods of time, should it be necessary to have supply to the user in a situation where the ambient temperature is below the anti-freeze threshold value.

Some structural features of the apparatus 1 are described below.

Preferably, the apparatus 1 comprises the aforementioned bypass duct 30 which branches off from the supply line S at a withdrawal point 5 upstream of the first valve 10 and ends directly in the bypass inlet 23 of the second valve 20. Such bypass duct is configured to withdraw a flow of fluid from the supply line, at a point upstream of the first valve, and bring it to the second valve.

Preferably, the bypass duct 30 branches off from the supply line S, at a point upstream of the first valve, directly by means of a fitting/branch placed along the supply line, preferably without valve elements.

Preferably, the first valve 10 is an automatic valve, actuated directly by the temperature sensor 50, and the second valve 20 is a manual user-activated valve.

Preferably, the first valve 10 is a three-way valve, and the shutter is shaped in such a way as to selectively place the inlet, the outlet and the discharge in communication with each other. Preferably, the body of the first valve has three openings defining the inlet 11, the outlet 12 and the discharge 13 and in communication with the inner chamber. Preferably, the inlet, the outlet and the discharge are mutually positioned in a "T" shape, with the inlet 11 and the outlet 12 aligned and the discharge 13 perpendicular to both.

Preferably, the second valve 20 is a three-way valve, and the respective shutter 24 is shaped in such a way as to selectively place the inlet, the outlet and the bypass inlet in communication with each other. Preferably, the body of the second valve has three openings defining the inlet 21, the outlet 22 and the bypass inlet 23 and in communication with the inner chamber. Preferably, the inlet, the outlet and the bypass inlet are mutually positioned in a "T" shape, with the inlet 21 and the outlet 22 aligned and the bypass inlet 23 perpendicular to both.

Preferably, as shown by way of example in FIGS. 2-4, the shutter 24 of the second valve, three-way shaped, has an internal "T" structure and is positioned in the inner chamber so that

- in the open configuration, the inlet 21 is in communication with the outlet 22 and at the same time the bypass inlet 23 is closed;
- in the bypass configuration, the inlet 21 is closed and at the same time the bypass inlet 23 is in communication with the outlet 22.

Preferably, the inlet 21 of the second valve 20 faces and is connected to said outlet 12 of the first valve 10.

Preferably, the inlet 21 of the second valve 20 is downstream of the outlet 12 of the first valve 10.

Preferably, the inner chamber of each valve is destined to be crossed by the fluid, between the inlet and the outlet selected according to the operating configuration of the valve.

The shutter of the first valve may be a ball shutter housed in the inner chamber.

Preferably, the shutter 24 of the second valve 20 is a ball shutter housed in the respective inner chamber. As shown schematically in the figures, the inlets and outlets 21, 22 and 23 of the second valve 20 are openings placed on three sides of the body of the valve itself, and the ball shutter rotates inside the chamber to define the operating configurations of the valve, placing each time the opening which acts as an inlet in communication with the opening which acts as an outlet.

Preferably, as in the exemplary embodiment shown in the figures, the body of the first valve 10 is distinct and separate from the respective body of the second valve 20. In this case, the two valves are placed, in series, along the supply line in two distinct points 3 and 4.

In a possible alternative embodiment (not shown), the device may comprise a single body defining internally, distinct from each other, the inner chamber of the first valve and the inner chamber of the second valve, and provided with both the inlet, the outlet and the discharge of the first valve, and with the inlet, the outlet and the bypass inlet of the second valve. In this case, the first and second valves are integrated in a single body located along the supply line. It should be noted that, in the case of a single body for both valves, inside the single body there is an inner passage connecting the inner chamber of the first valve with the inner chamber of the second valve. In particular, such passage connects the outlet of the first valve with the inlet of the second valve.

Preferably, the temperature sensor 50 is destined to be positioned in an external environment with respect to the first and/or second valve.

Preferably, the temperature sensor 50 is destined to be positioned in the same environment in which the user U supplied by the supply line S is located.

Preferably, the user U is a water supply point for outdoor use, for example a tap or an irrigation pipe.

Preferably, the aforesaid fluid is water.

Preferably, the fluid supply line S is a duct of a sanitary water system, and such duct is configured to supply a user, for example a tap, preferably located in an external environment.

Preferably, the user U is located in an external environment with respect to the first and/or the second valve.

Preferably, the supply line S is part of a water or thermo-hydraulic system.

Preferably, the supply line is a domestic cold water supply duct.

Preferably, the supply line S consists of a series of ducts bringing said fluid towards the user U and is characterized by a flow direction of the fluid during normal use, such direction being directed by the fluid source (e.g. a system source of sanitary water) to the user.

The expression "operatively located along said supply line" means that the valve is mounted along the duct defining the supply line, thus intercepting the supply line so that the flow of fluid in transit in the supply line can be controlled by the valve. The valve located on the supply line duct locally interrupts the continuity of such duct.

The apparatus 1 may be in an assembled condition, i.e. having the first valve, the second valve and the bypass duct installed on the supply line.

Alternatively, the apparatus 1 may be in the form of a "kit" (i.e. equipment, a set of components) comprising at least the first valve, the second valve, the bypass duct and preferably the temperature sensor, each of these components being ready to be installed in the respective position of the supply line or of the environment in which the user supplied by the power supply line is located.

Basically, the apparatus of the present invention may be a disassembled kit (i.e. a set of components to make the apparatus) or assembled in the destination system. The apparatus of the present invention is such both in the disassembled condition (for example with the components contained in a package, destined for sale or at a place of use), and in the assembled condition (i.e. the apparatus installed on site, in a hydraulic system).

A method for controlling the distribution of a fluid along a supply line according to the present invention is described below.

The method comprising the steps of:

- providing an apparatus 1 according to the present invention, as described above;
- installing the first valve 10 operatively placing it along the supply line S;
- installing the second valve 20 operatively placing it along the supply line S, at a point downstream of the first valve 10, along the normal flow direction of the fluid in the supply line S towards the user U, so that the inlet 21 of the second valve 20 follows the outlet 12 of the first valve 10;
- installing the bypass duct 30, making it branch off from the supply line S at a point upstream of the first valve 10, so that it can draw fluid from the supply line S to bring it directly to the second valve 20, in particular to the bypass inlet 23 of the second valve;
- selecting the operating condition of the apparatus 1, from one of the following operating conditions:
  - a condition of normal supply (FIG. 2), in which the first valve 10 is in the configuration of normal use (ON) and at the same time the second valve 20 is in the open configuration (OFF);
  - an antifreeze closed condition (3), in which the first valve 10 is in the safety closed configuration (OFF) and at the same time the second valve 20 is in the open configuration (OFF);
  - "bypass condition (FIG. 4), in which the first valve 10 is in the safety closed configuration (OFF) and at the same time the second valve 20 is in the bypass configuration (ON).

Preferably, the method comprises a step of installing the temperature sensor 50, preferably positioning it in the same environment in which the user U supplied by the supply line S is located.

Preferably, the method comprises a step of measuring a temperature value by means of the temperature sensor 50 and controlling the movement of the control members of the first valve 10 to determine the operating configuration of the first valve, according to the following control logic:

- if the temperature sensor 50 measures a temperature value above a certain settable threshold value, the first valve 10 is kept in the configuration of normal use;
- if the temperature sensor 50 measures a temperature value below said threshold value, the first valve 10 is brought into the safety closed configuration.

Preferably, in the step of selecting the operating condition of the apparatus 1, the selection of the antifreeze closed condition occurs automatically on the basis of the comparison between the temperature measured by the temperature sensor 50 and the set threshold value. In fact, preferably the first valve 10 is an automatic valve controlled by the temperature sensor, so that the transition of the first valve between the normal use configuration and the safety closed configuration occurs automatically on the basis of the comparison between the temperature measured by the temperature sensor and the set threshold value.

Preferably, in the step of selecting the operating condition of the apparatus 1, the selection of the bypass condition occurs voluntarily, by a user, bringing the second valve 20 into the bypass configuration when the first valve 10 is in the safety closed configuration, to bring the supply fluid to the user U through the bypass duct 30.

Preferably, the voluntary selection of the bypass condition occurs through a manual activation of the second valve 20 by the user.

The voluntary selection of the bypass condition may occur by means of a remote control, by the user, for example by means of an electronic control device and/or a software application, of the second valve, to bring it into the bypass configuration.

Preferably, in the step of selecting the operating condition of the apparatus 1, the selection of the normal supply condition of the apparatus corresponds to a default condition for the apparatus 1 installed on the supply line S, active when the temperature in the place of installation of the temperature sensor 50 is higher than a threshold value below which fluid freezing can occur inside the supply line.

Preferably, in the step of selecting the operating condition of the apparatus 1, the selection of the antifreeze closed condition of the apparatus takes place, preferably automatically (i.e. without the intervention of a user), when the temperature in the place of installation of the temperature sensor 50 is lower than a threshold value below which fluid can freeze inside the supply line.

Preferably, in the step of selecting the operating condition of the apparatus 1, the selection of the bypass condition of the apparatus takes place, preferably voluntarily (i.e. with the intervention of a user) when the temperature in the place of installation of the temperature sensor 50 is lower than a threshold value below which fluid can freeze inside the supply line S, and the first valve 10 is therefore in a safety closed configuration, but it is still required to supply the user U with fluid brought by the supply line, and therefore the second valve 20 is brought into the bypass configuration, to bring fluid to the user U through the bypass duct 30 and the second valve 20, bypassing the first valve 10.

Preferably, if the operating condition selected for the apparatus 1 is the bypass condition, and it is no longer required—by the user—to supply the user with fluid brought by the supply line, it is provided to return to the antifreeze closed condition of the apparatus, by deactivating the bypass duct 30, obtained by bringing (preferably manually) the second valve 20 to the open configuration.

In this way, the first valve 10 blocks the flow of fluid arriving at its inlet, at the same time there is no fluid entering the second valve 20 from the bypass duct 30, and it is possible to discharge the fluid present downstream of the first valve 10 (up to the user U point) by sliding it backwards (in the direction opposite to the normal supply direction) up to the outlet 12 of the first valve and from there to the discharge 13.

In other words, once the use of the user U has finished, obtained by selecting the bypass condition, it is necessary to return the apparatus 1 to the antifreeze closed condition, restoring the safety operation of the apparatus. Once the temperature has risen above the threshold value, the device will automatically go to normal supply conditions.

Preferably, in the step of selecting the operating condition of the apparatus 1, the apparatus may be, at any time, only in one of the aforesaid operating conditions.

A method for installing an apparatus 1 for controlling the distribution of a fluid along a supply line S, according to the present invention, is described below.

The installation method includes the steps of:

providing an apparatus 1 according to the present invention, as described above;

installing the first valve 10 operatively placing it along the supply line S;

installing the second valve 20 operatively placing it along the supply line S, at a point downstream of the first valve 10, along the normal flow direction of the fluid in the supply line S towards the user U, so that the inlet 21 of the second valve 20 follows the outlet 12 of the first valve 10;

installing the bypass duct 30, making it branch off from the supply line S at a withdrawal point 5 upstream of the first valve 10, so that it can draw fluid from the supply line to bring it to the second valve 20, in particular to the bypass inlet 23 of the second valve 20.

Preferably, the installation method comprises a step of installing the temperature sensor 50, preferably positioning it in the same environment in which the user U supplied by the supply line S is located.

The invention thus conceived is subject to numerous modifications and variants, all falling within the scope of the inventive concept, and the components mentioned may be replaced by other technically equivalent elements.

The invention therefore achieves important advantages. First of all, as is clear from the above description, the invention allows at least some of the drawbacks of the prior art to be overcome.

The apparatus and method described above allow the distribution of a fluid through a distribution line to be efficiently controlled, and at the same time allow an effective antifreeze safety function to be implemented.

In particular, the apparatus-by virtue of the presence of the first and second valves and the bypass duct-allows a normal supply condition, an antifreeze closed condition and a bypass condition to be defined, and the most appropriate condition to be used at any time to be selected.

Furthermore, the automatic control of the first valve (controlled by the temperature sensor) combined with the control of the second valve by the user allow an automatic transition from the normal supply condition to the antifreeze closed condition and a manual (temporary) transition from the antifreeze closed condition to the bypass condition. This means that the apparatus is capable of autonomously managing external temperature conditions that could lead to freezing phenomena in the distribution line, with consequent damage and malfunctions, and it does so by automatically setting itself to the antifreeze closed condition. Furthermore, the apparatus also allows the user to dispose of fluid (typically water) for the user in any case, and does so by providing a manual control for the user who brings the apparatus to the bypass condition. At the end of the activity for which it is necessary to activate the bypass, the user closes the second valve and the apparatus automatically returns to the antifreeze closed condition, to guarantee the safety of the system and avoid freezing phenomena. When the temperature value is exceeded, beyond which there is no risk of freezing, the apparatus automatically returns to normal supply conditions, supplying fluid to the user without the need to activate the bypass. In summary, the apparatus combines automatic operation with regard to the management of freezing risks (opening-closing of the normal supply line based on the external temperature measured by the sensor), with an additional manual operation that allows the operator, by acting on the second valve, to bypass the automatic control carried out by the first valve.

Overall, the apparatus and the method of the present invention offer a simple and effective antifreeze control function, and at the same time allow a quick and convenient activation of the supply fluid flow to be supplied to the user in case of need.

This is made possible by the combined use of the first valve, which is automatic and safe and autonomously manages the antifreeze function, without the need for the user to remember to close the supply line when the temperature drops to freezing levels, and the second valve, which adds the possibility of being able to use the user in any case when needed, thanks to the activation of the bypass. Basically, the present invention combines the automated operation (first valve and temperature sensor) for the management of the low temperature condition (possible freezing) in the external environment, with a voluntary management of the bypass (second valve and bypass duct) when—even with external environment in a low temperature situation—the user still wishes to use the utility.

The apparatus and the method according to the present invention advantageously allow having different operating modes for controlling the distribution of a fluid along a supply line, and in particular both an antifreeze safety function and a bypass function.

This makes the apparatus and the method of the present invention safe from the point of view of the management of the antifreeze function and at the same time suitable for the different needs of a user.

A further advantage of the apparatus and of the method according to the present invention is given by the possibility of being made and implemented in a simple and rapid manner.

Furthermore, the apparatus and the method according to the present invention are characterized by a simple and rational structure and operation.

The apparatus and the method according to the present invention constitute alternative and original solutions, with respect to the prior art, for controlling the distribution of a fluid along a supply line.

The invention claimed is:

1. Apparatus (1) for controlling the distribution of a fluid along a supply line (S), configured to supply a user (U), or multiple users, with said fluid, the apparatus comprising:

a first hydraulic valve (10), destined to be operatively located along said supply line (S) and provided with:

an inlet (11), configured to receive a flow of fluid in transit in said supply line (S) upstream of the first valve (10);

an outlet (12), configured to transmit a flow of fluid through the first valve and to make it continue along the supply line (S) downstream of the first valve (10), or to receive fluid coming from a portion of the supply line (S) downstream of the first valve (10);

a discharge (13), configured to discharge outside the supply line (S)—through the first valve (10)—fluid present in the supply line and preferably coming from a portion of the supply line (S) downstream of the first valve (10);

movable control members configured to selectively allow or prevent the passage of fluid, present in the supply line (S) and passing through the first valve (10), between said inlet (11), said outlet (12) and said discharge (13) of the first valve (10);

a second hydraulic valve (20), destined to be operatively located along said supply line (S) at a point downstream from the first valve (10), along the direction of normal flow of the fluid in the supply line (S) towards said user (U), the second valve (20) being provided with:

a respective inlet (21), configured to receive a flow of fluid in transit in said supply line (S) and coming from said outlet (12) of the first valve (10);

a respective outlet (22), configured to transmit a flow of fluid through the second valve (20) and to make it continue along the supply line, downstream of the second valve;

a bypass inlet (23), configured to receive a flow of fluid drawn from the supply line (S) at a withdrawal point (5) upstream of the first valve (10) and brought directly to the second valve (20) by means of a bypass duct (30) branching off from the supply line (S) upstream of the first valve (10);

respective movable control members configured to selectively allow or prevent the passage of fluid, present in the supply line (S) and/or in the bypass duct (30) and passing through the second valve (20), between said inlet (21), said outlet (22) and said bypass inlet (23) of the second valve (20).

2. The apparatus (1) according to claim 1, wherein the first valve (10) comprises a body on which said inlet (11), said outlet (12) and said discharge (13) are defined, the body defining an inner chamber of the first valve, in which the passage of fluid takes place, and wherein said control members of the first valve comprise at least one shutter (14) housed in said inner chamber, the shutter being selectively movable in said chamber to define operating configurations of the first valve (10), and/or wherein said operating configurations of the first valve (10) include at least:

a configuration of normal use, in which the shutter (14) is positioned in the inner chamber of the first valve in such a way as to put the inlet (11) in communication with the outlet (12) of the first valve (10), to thus transmit fluid from the inlet to the outlet, and simultaneously close the discharge (13);

a safety closed configuration, in which the shutter (14) is positioned in the inner chamber of the first valve in such a way as to close the inlet (11) without transmitting fluid through the first valve (10), and at the same time put the outlet (12) in communication with the discharge (13), so that the fluid present in the supply line (S) downstream of the outlet (12) of the first valve (10) is transmitted through the outlet to the discharge (13) of the first valve.

3. The apparatus (1) according to claim 2, wherein in the configuration of normal use the inlet (11) and the outlet (12) of the first valve are open and the discharge (13) is closed and in the safety closed configuration the inlet (11) is closed and the outlet (12) and discharge (13) are open, and/or wherein in the configuration of normal use the flow of fluid in transit in the supply line (S) crosses the first valve (10) without interruptions and can supply said user (U), or said multiple users;

and/or wherein in the safety closed configuration, the flow of fluid passing through the supply line (S) is blocked by the first valve (10) and cannot cross it to proceed towards the second valve (20);

and/or wherein, in a safety configuration, the fluid present in the supply line (S) downstream of the outlet of the first valve (10) flows in the opposite direction to the flow direction of the fluid during normal use, and thus it is brought progressively to the outlet (12) of the first valve (10), and from the outlet (12) to the discharge (13).

4. The apparatus (1) according claim 1, wherein the second valve (20) comprises a body on which said respective inlet (21), said respective outlet (22) and said bypass inlet (23) are defined, the body defining a respective inner chamber of the second valve (20), in which the passage of fluid takes place, and wherein said control members of the second valve comprise at least one respective shutter (24) housed in said inner chamber, the shutter being selectively movable in said chamber to define operating configurations of the second valve (20), and/or wherein said operating configurations of the second valve (20) include at least:

an open configuration, in which the shutter (24) is positioned in the inner chamber of the second valve (20) in such a way as to put the inlet (21) in communication with the outlet (22) of the second valve, to thus transmit fluid from inlet to outlet, or vice versa from outlet to inlet, and at the same time close the bypass inlet (23);

a bypass configuration, in which the shutter (24) is positioned in the inner chamber of the second valve in such a way as to close the inlet (21) and simultaneously put the bypass inlet (23) in communication with the outlet (22) of the second valve (20), so that the fluid present in the bypass duct (30), branching off from the supply line (S) upstream of the first valve and carrying a flow of fluid from the supply line, is transmitted—through the outlet (22) of the second valve (20)—downstream of the second valve along the supply line (S).

5. The apparatus (1) according to claim 4, wherein in the open configuration the inlet (21) and outlet (22) of the second valve (20) are open and the bypass inlet (23) is closed and in the configuration the bypass input (21) is closed and the outlet (22) and the bypass inlet (23) are open, and/or wherein in the open configuration the flow of fluid in transit in the supply line (S), coming from the outlet (12) of the first valve (10), if the first valve is in the configuration of normal use, or directed to the outlet (12) of the first valve (10), if the first valve is in the safety closed configuration, it can pass through the second valve (20) without interruptions respectively to supply said user (U), or said multiple users, or to be sent to the discharge (13) of the first valve (10), and/or wherein in the bypass configuration the flow of fluid along the supply line (S) between the first valve (10) and the second valve (20) is blocked and the passage from the bypass line (30) is opened through the second valve (20), to transmit fluid from the bypass duct (30) to the supply line (S) downstream of the second valve (20).

6. The apparatus (1) according to claim 1, wherein the apparatus is configured to selectively operate at least between the following operating conditions:

a condition of normal supply, in which the first valve (10) is in said configuration of normal use and at the same time the second valve (20) is in said open configuration;

an antifreeze closed condition, in which the first valve (10) is in said safety closed configuration and at the same time the second valve (20) is in said open configuration;

a bypass condition, in which the first valve (10) is in said safety closed configuration and at the same time the second valve (20) is in said bypass configuration, and wherein each of said operating conditions of the apparatus is defined by the combination of the operating configuration of the first valve (10) and the operating configuration of the second valve (20).

7. The apparatus (1) according to claim 1, comprising a temperature sensor (50) configured to measure a temperature value, said temperature sensor being connectable to, and/or operatively active on, said first valve (10), for controlling the movement of said control members of the first valve and determining the operating configuration of the first valve, and/or wherein the device is configured in such a way that:

if the temperature sensor (50) measures a temperature value above a certain settable threshold value, the first valve (10) is kept in said configuration of normal use;

if the temperature sensor (50) measures a temperature value below said threshold value, the first valve (10) is brought into said safety closed configuration;

and/or wherein the temperature sensor (50) is destined to be positioned in an external environment with respect to the first and/or second valve, preferably the same environment in which said user (U), or said multiple users, is/are located, supplied by the supply line (S).

8. The apparatus (1) according to claim 7, wherein the temperature sensor (50) is a capillary or fluid expansion sensor, and is connected by means of a thin tube to the shutter (14) of the first valve (10), for determining the transition thereof between the normal use configuration and the safety closed configuration on the basis of the temperature value measured with respect to the threshold value, and/or wherein the first valve (10) is a motorized valve provided with an actuator (15) configured to automatically move the shutter (14), and the temperature sensor (50) is an electronic sensor configured to send a command signal to suitable processing means (16) of the first valve (10) configured to receive said command signal and operate said actuator (14), the command signal being able to be a temperature signal higher than said threshold value, which determines the movement of the shutter (14) by the actuator (15) to bring the valve to the configuration of normal use, or a temperature signal lower than said threshold value, which determines the movement of the shutter (14) by the actuator (15) to bring the valve into the safety closed configuration, and/or wherein said threshold value is an antifreeze safety value, for example 10° C. or 5° C. or 3° C., selected to avoid freezing of the fluid inside the supply line (S).

9. The apparatus (1) according to claim 1, wherein the first valve (10) is an automatic valve controlled by said temperature sensor (50), so that the transition of the first valve (10) between the configuration of normal use and the safety closed configuration occurs automatically on the basis of the comparison between the temperature measured by the temperature sensor (50) and the set threshold value, and/or wherein the second valve (20) can be activated voluntarily by a user in such a way as to select at will the operating configuration of the second valve, and in particular to bring the second valve (20) into the bypass configuration when the first valve (10) is in the safety closed configuration, to bring the supply fluid to the user (U), or to the users, through the bypass duct (30).

10. The apparatus (1) according to claim 1, wherein said condition of normal supply of the apparatus is an active condition when the temperature in the place of installation of the apparatus or of the user (U) supplied by the supply line (S) at which the apparatus is installed, is higher than a threshold value below which fluid freezing can occur inside the supply line, and/or wherein said antifreeze closed condition of the apparatus is a condition activated when the temperature in the place of installation of the apparatus or of the user (U) supplied by the supply line (S) at which the apparatus is installed, is below a threshold value below which fluid freezing can occur inside the supply line, and/or wherein said apparatus bypass condition is a condition that can be activated when the temperature in the place of installation of the apparatus or of the user (U) supplied by the supply line (S) at which the apparatus is installed is lower than a threshold value below which fluid freezing can occur inside the supply line, and the first valve (10) is therefore in a safety closed configuration, but it is still desired to supply said user (U) with fluid carried by the supply line (S), and therefore said second valve (20) is brought into the bypass configuration, to bring fluid to the user through the bypass duct (30) and the second valve (20), bypassing the first valve (10).

11. The apparatus (1) according to claim 1, comprising said bypass duct (30) branching off from the supply line (S) in a withdrawal point (5) upstream of the first valve (10) and ending in the bypass inlet (23) of the second valve (20), and/or wherein the first valve (10) is an automatic valve, actuated directly by the temperature sensor (50), and the second valve (20) is a user-activated valve, and/or wherein the first valve (10) is a three-way valve, and said shutter (14) is shaped in such a way as to selectively place the inlet (11), the outlet (12) and the discharge (13) in communication, and wherein the body of the first valve has three openings defining the inlet, the outlet and the discharge and in communication with the inner chamber, and/or wherein the second valve (20) is a three-way valve, and the respective shutter (24) is shaped in such a way as to selectively put the inlet (21), the outlet (22) and the bypass inlet (23) in communication with each other, and wherein the body of the second valve has three openings defining the inlet, the outlet and the bypass inlet and in communication with the inner chamber.

12. Method for controlling the distribution of a fluid along a supply line (S), the method comprising the steps of:

providing an apparatus (1) according to claim 1, and in particular providing at least the first valve (10), the second valve (20) and a bypass duct (30);

installing the first valve (10) operatively placing it along the supply line (S);

installing the second valve (20) operatively placing it along the supply line (S), at a point downstream of the first valve (10), along the normal flow direction of the fluid in the supply line (S) towards said user (U), so that the inlet (21) of the second valve (20) follows the outlet (12) of the first valve (10);

installing the bypass duct (30), making it branch off from the supply line (S) at a withdrawal point (5) upstream of the first valve (10), so that it can draw fluid from the supply line (S) to bring it to the second valve (20), in particular to the bypass inlet (23) of the second valve;

selecting the operating condition of the apparatus, from one of the following operating conditions:

a condition of normal supply, in which the first valve (10) is in the configuration of normal use and at the same time the second valve (20) is in the open configuration;

an antifreeze closed condition, in which the first valve (10) is in the safety closed configuration and at the same time the second valve (20) is in the open configuration;

a bypass condition, in which the first valve (10) is in the safety closed configuration and at the same time the second valve (20) is in the bypass configuration.

13. The method according to claim 12, comprising a step of installing a temperature sensor (50), preferably positioning it in the same environment in which the user (U) supplied by the supply line (S) is located, and a step of measuring a value by means of the temperature sensor (50) and controlling the movement of the control members of the first valve (10) to determine the operating configuration of the first valve, according to the following control logic:

if the temperature sensor (50) measures a temperature value above a certain settable threshold value, the first valve (10) is kept in said configuration of normal use;

if the temperature sensor (50) measures a temperature value below said threshold value, the first valve (10) is brought into said safety closed configuration.

14. The method according to claim 12, wherein, in said step of selecting the operating condition of the apparatus (1), the selection of the antifreeze closed condition occurs automatically on the basis of the comparison between the temperature measured by the temperature sensor (50) and the set threshold value, the first valve (10) being an automatic valve controlled by the temperature sensor (50), and/or wherein, in said step of selecting the operating condition of the apparatus, the selection of the bypass condition occurs voluntarily, by a user, bringing the second valve (20) into the bypass configuration when the first valve (10) is in the safety closed configuration, to bring the supply fluid to the user (U) through the bypass duct (30), and/or wherein, in said step of selecting the operating condition of the apparatus (1), the selection of the normal supply condition of the apparatus (1) corresponds to a default condition for the apparatus installed on the supply line (S), active when the temperature in the place of installation of the temperature sensor (50) is higher than a threshold value below which fluid freezing can occur inside the supply line.

15. Method of installing an apparatus (1) for controlling the distribution of a fluid along a supply line (S), the method comprising the steps of:

providing an apparatus (1) according to claim 1, and in particular providing at least the first valve (10), the second valve (20) and a bypass duct (30);

installing the first valve (10) operatively placing it along the supply line (S);

installing the second valve (20) operatively placing it along the supply line (S), at a point downstream of the first valve, along the normal flow direction of the fluid in the supply line (S) towards said user (U), so that the inlet (21) of the second valve (20) follows the outlet (12) of the first valve (10);

installing the bypass duct (30), making it branch off from the supply line (S) at a withdrawal point (5) upstream of the first valve (10), so that it can draw fluid from the supply line (S) to bring it to the second valve (20), in particular to the bypass inlet (23) of the second valve (20), and/or wherein the method comprises a step of installing the temperature sensor (50), preferably positioning it in the same environment in which the user (U) supplied by the supply line (S) is located.

* * * * *